US005673903A

United States Patent [19]

Lewis

[11] Patent Number: 5,673,903

[45] Date of Patent: Oct. 7, 1997

[54] APPARATUS FOR TEMPORARILY SUPPORTING ONE END OF A CROSS PIECE DURING THE CONSTRUCTION OF A DECK OF FENCE RAIL

[76] Inventor: Robert W. Lewis, 1564 Highway 70, Swannanoa, N.C. 28778

[21] Appl. No.: 555,087

[22] Filed: Nov. 8, 1995

[51] Int. Cl.[6] ..... B25B 1/02

[52] U.S. Cl. ..... 269/41; 269/904

[58] Field of Search ..... 269/41, 97, 98, 269/152–155, 904, 257

[56] References Cited

U.S. PATENT DOCUMENTS

| | | | |
|---|---|---|---|
| 2,680,459 | 6/1954 | Dodson et al. . | |
| 2,778,393 | 1/1957 | Golasowski | 269/152 |
| 3,914,871 | 10/1975 | Wolff . | |
| 4,749,176 | 6/1988 | Bradshaw . | |
| 4,836,517 | 6/1989 | Vossler . | |
| 5,192,059 | 3/1993 | Silver . | |
| 5,388,813 | 2/1995 | Arsenault | 269/98 |

*Primary Examiner*—Robert C. Watson
*Attorney, Agent, or Firm*—Carter & Schnedler

[57] ABSTRACT

There is provided an apparatus which is used to temporarily support one end of a cross piece during construction of a deck or fence rail. The apparatus is in the form of a C-shaped frame having an elongated base plate and a pair of leg plates extending from each end of the base plate. An adjustable clamp member is attached to one of the legs for securing the apparatus to a first vertical beam. A platform is attached to the other leg and receives one end of the cross piece for holding that end of the cross piece in position on one beam while the other end is secured to a second adjacent spaced apart beam. Once a cross piece has been attached to the two adjacent beams, the clamp may be flipped over and the other side of the clamp may be attached to the second beam so that another cross piece may be abutted against the first cross piece and attached between the second beam and a third beam. The apparatus enables cross pieces to be attached to beams by one person.

10 Claims, 5 Drawing Sheets

APPARATUS FOR TEMPORARILY SUPPORTING ONE END OF A CROSS PIECE DURING THE CONSTRUCTION OF A DECK OF FENCE RAIL

BACKGROUND OF THE INVENTION

This invention relates to the construction of decking rails and fences.

More particularly, it relates to devices which enable a single person to properly attach cross pieces to adjacent beams during the construction of decking rails and fences.

During the construction of rails for decking and fences, it is necessary to fasten horizontal cross pieces to vertical beams which are spaced apart as much as eight feet. Proper construction requires that these cross pieces be exactly horizontal or level. In order to fasten a horizontal beam to two vertical spaced apart beams, two persons are normally required. The first person holds the cross piece in position on the first beam. The second person finds the proper position of the cross piece on the second beam by holding the level onto the cross piece until it shows that the beam is level. The second person then fastens the cross piece to the second beam and then goes to the first beam and fastens the cross piece to the first beam. Obviously, the labor required using this technique is substantial and wasteful in that one person is simply holding a beam in place.

It is therefore desirable to provide an apparatus which will enable a single person to properly fasten a cross piece to a pair of adjacent beams.

OBJECTS OF THE INVENTION

It is therefore one object of this invention to provide an apparatus for enabling a single person to properly install cross pieces to adjacent beams.

It is another object of this invention to provide an apparatus which is inexpensive to produce and easy to use.

It is still another object of this invention to provide an apparatus for enabling a single person to install two cross pieces on three adjacent beams, both for the end beams.

SUMMARY OF THE INVENTION

In accordance with one form of this invention, there is provided an apparatus for temporarily supporting one end of a cross piece during the installation of the cross piece to a pair of spaced apart beams. The apparatus includes a C-shaped frame, including a base, and first and second legs extending from the ends of the base. The C-shaped frame is adapted to partially surround one of the beams. A platform is attached to the first leg. The platform receives one end of the cross piece for holding the cross piece in position on the beam while the cross piece is secured to the other spaced apart beam.

It is preferred that one side of the platform is situated such that when the frame is in a first position, the cross piece will abut against the base so that the end of the cross piece will be flush with an edge of the beam, and when the other side of the platform is situated such that the cross piece will not abut against the base so that when the frame is flipped over, a cross piece may abut against another cross piece which has been already attached to the other beam, preferably at the center of the other beam.

BRIEF DESCRIPTION OF THE DRAWINGS

The subject matter which is regarded as the invention is set forth in the appended claims. The invention itself, however, together with further objects and advantages thereof may be better understood inference to the accompanying drawings in which:

DESCRIPTION OF THE PREFERRED EMBODIMENT

Figure 1:
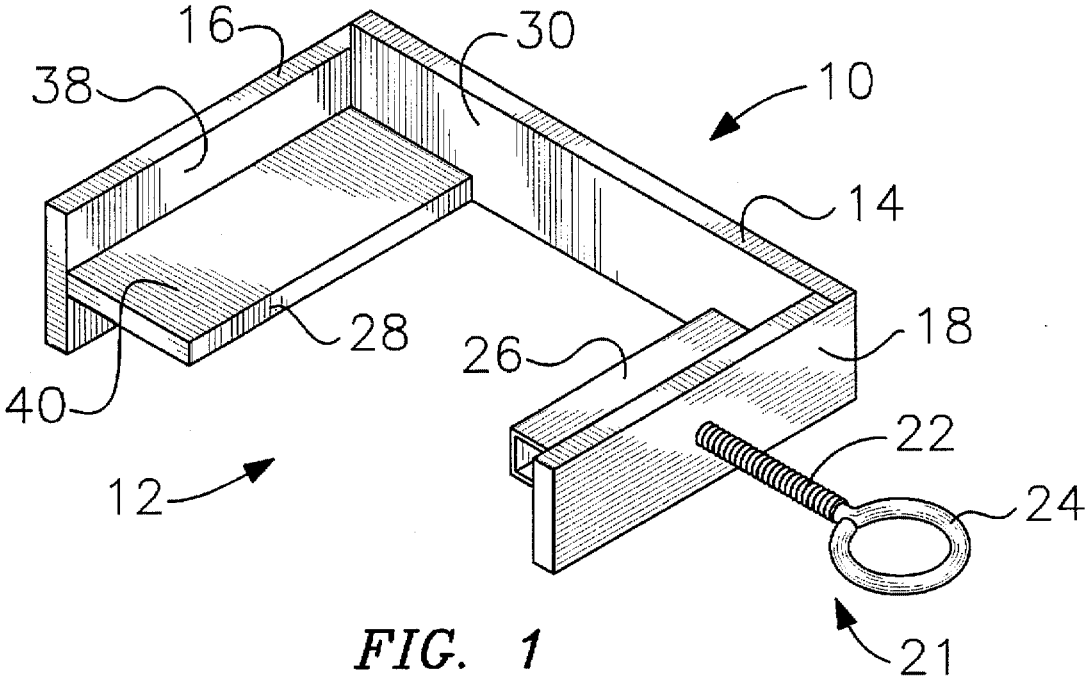
FIG. 1 is a pictorial view showing one side of the apparatus of the subject invention.
Figure 2:
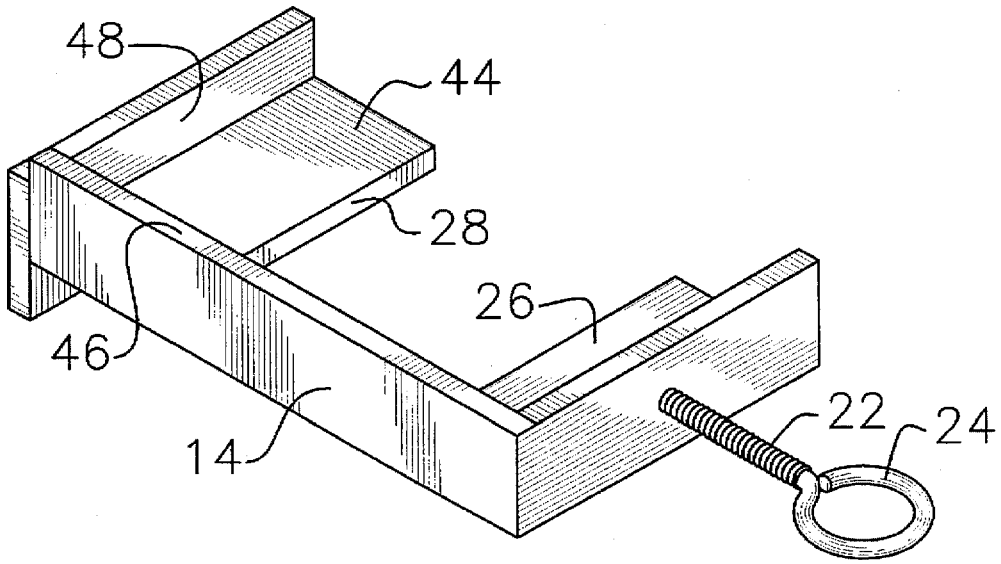
FIG. 2 is a pictorial view showing the other side of the apparatus of the subject invention.
Figure 3:
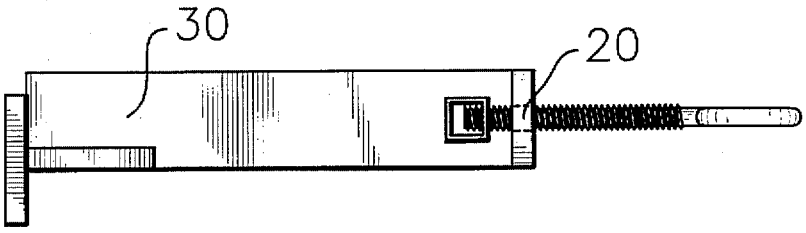
FIG. 3 is a front elevational view of the apparatus of FIG. 1.
Figure 4:
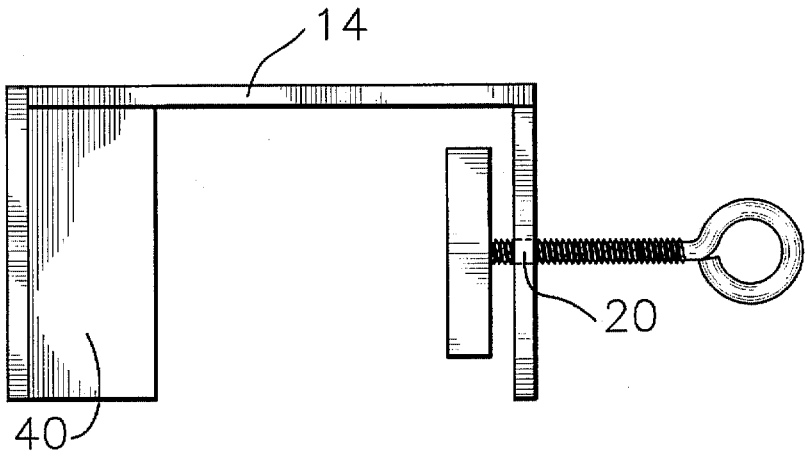
FIG. 4 is a top view of the apparatus of FIG. 1.
Figure 5:
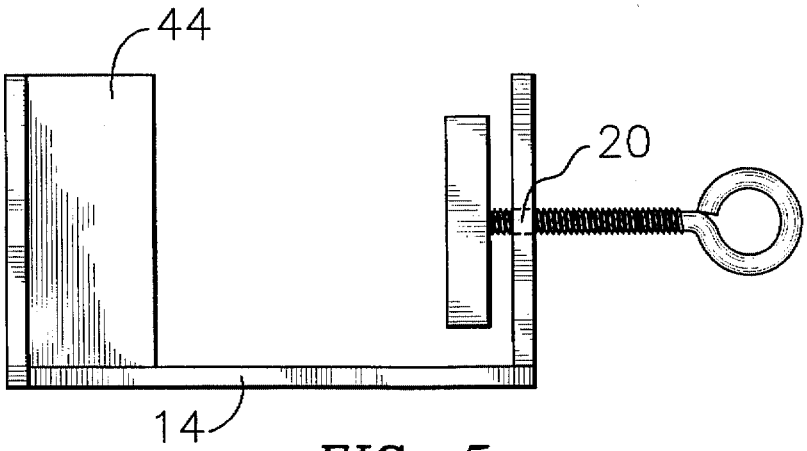
FIG. 5 is a bottom view of the apparatus of FIG. 1.
Figure 6:
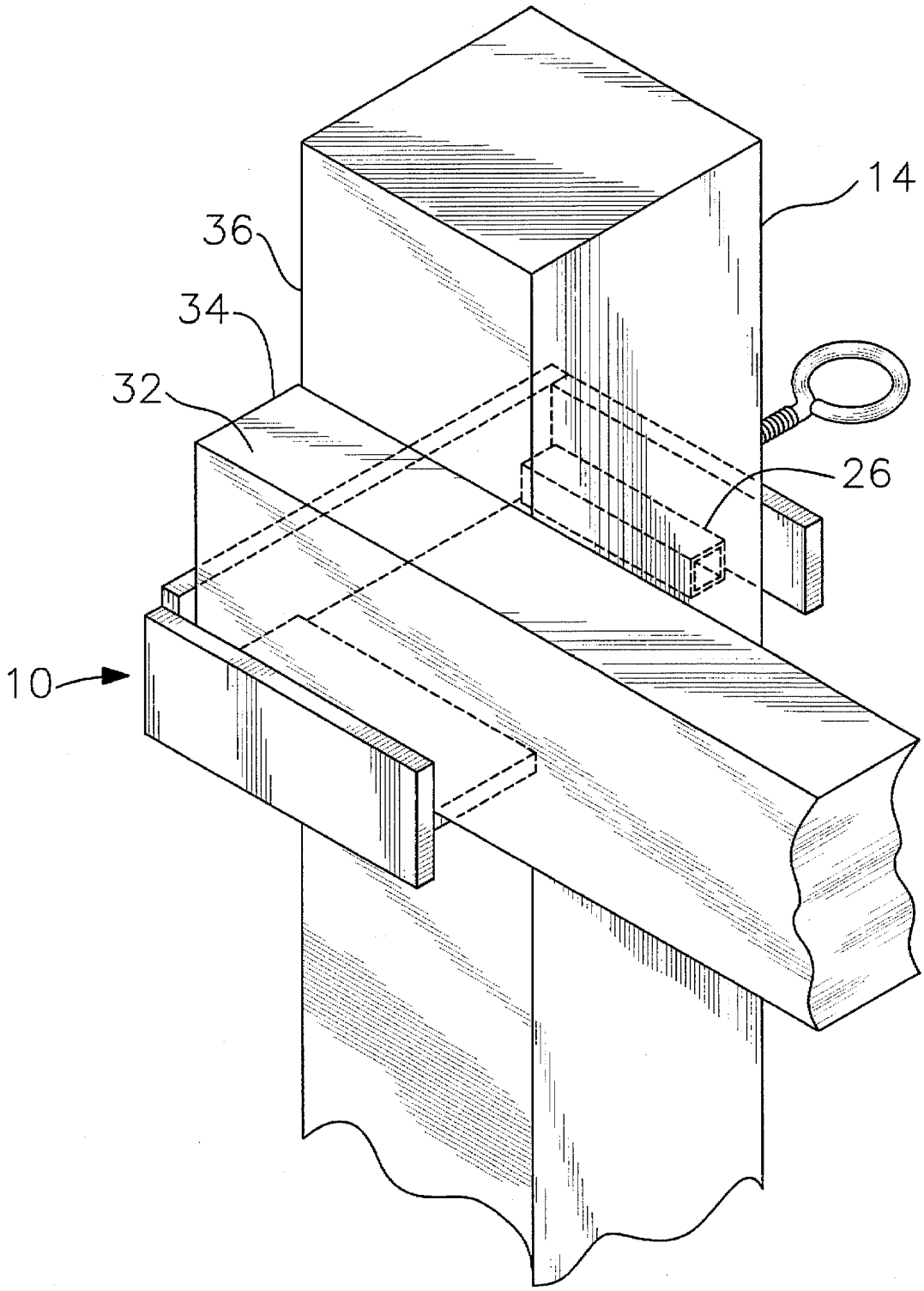
FIG. 6 is a pictorial view of the apparatus of the subject invention in the position shown in FIG. 1 attached to a vertical beam and receiving a single cross piece.

Referring now more particularly to FIGS. 1–9, there is provided a C-shaped frame 10 having an opening 12 so that the frame may be received about a portion of vertical beam 15, as shown in FIG. 6. Frame 10 includes an elongated base metal plate 14 and a pair of legs 16 and 18 extending from the ends of base 14. Legs 16 and 18 are also in the form of metal plates. Legs 16 and 18 are preferably welded to base 14. Leg 18 includes a hole 20 drilled therethrough, as shown in FIGS. 3–5. A threaded rod 22 is received through hole 20. Threaded rod 22 includes handle 24 connected to one end thereof and pressure plate 26 connected to the other end thereof, thereby forming an adjustment member or clamp 21. Pressure plate 26 abuts against one side of vertical beam 15, as shown in FIG. 6, to clamp frame 10 in place on the beam 15.

Platform 28 is attached to leg 16, preferably at an intermediate level on leg 16. In addition, platform 28 is attached to base 14 so that the back surface 30 of base 14 will act as a stop for cross piece 32, as shown in FIG. 6, which will enable end 34 of cross piece 32 to align with the rear edge 36 of beam 15 since the rear of beam 15 also rests against the back surface 30 of plate 14. A portion of cross piece 32 also abuts against inside surface 38 of leg 16. The top surface 40 of platform 28, the inside surface 38 of leg 16, the back surface of plate 14, as well as one side of beam 15, form a channel for receiving and supporting the end of cross piece 32.

Figure 8:
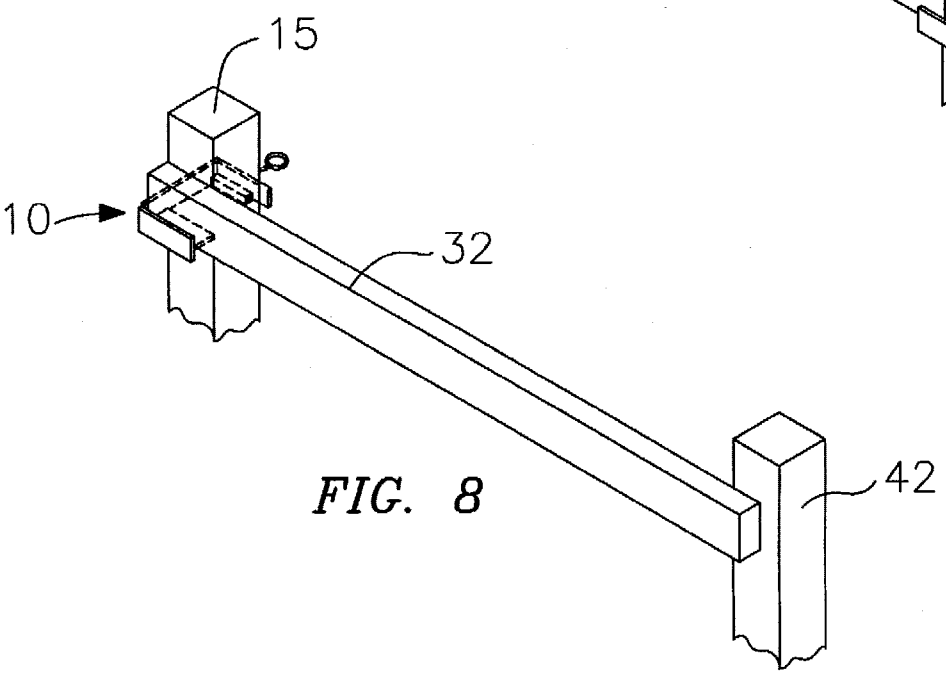
FIG. 8 is a pictorial view showing the apparatus in the position shown in FIG. 1 attaching a cross piece to an end beam and its adjacent post.

With cross piece 32 held in position on beam 15 by the C-shaped frame 10, as shown in FIG. 8, the carpenter may then affix the cross piece 32 at a position on beam 42 so that the cross piece is perfectly level. After the cross piece 32 has been affixed to beam 42, the carpenter may then go mark the spot on the top edge of cross piece on beam 15, remove clamp 10, and then affix cross piece 32 to beam 15. Thus the fencing or deck rail, as shown in FIG. 8, may be properly constructed by a single carpenter.

Figure 7:
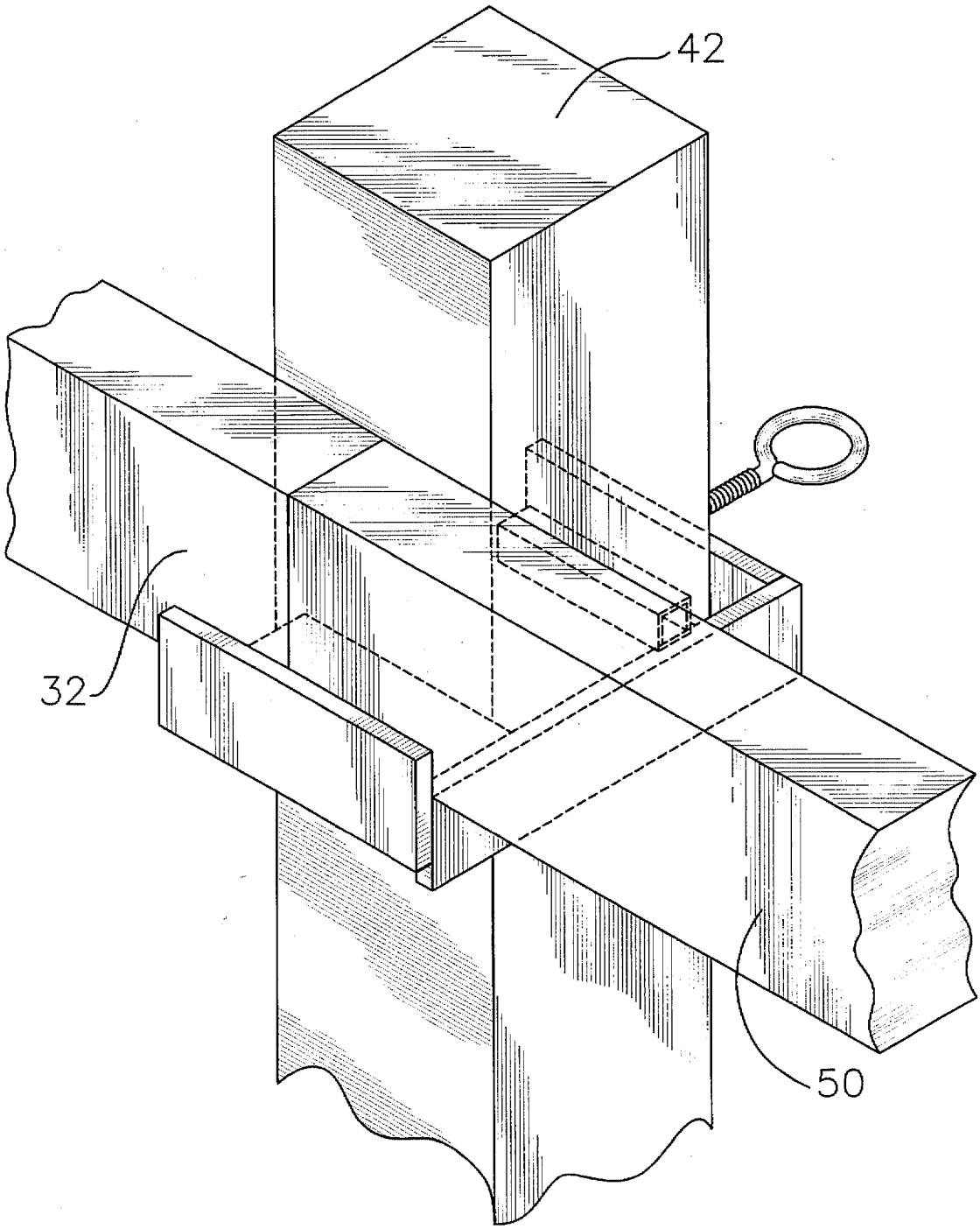
FIG. 7 is a pictorial view of the apparatus in the position shown in FIG. 2 attached to a vertical beam and receiving a pair of cross pieces.
Figure 9:
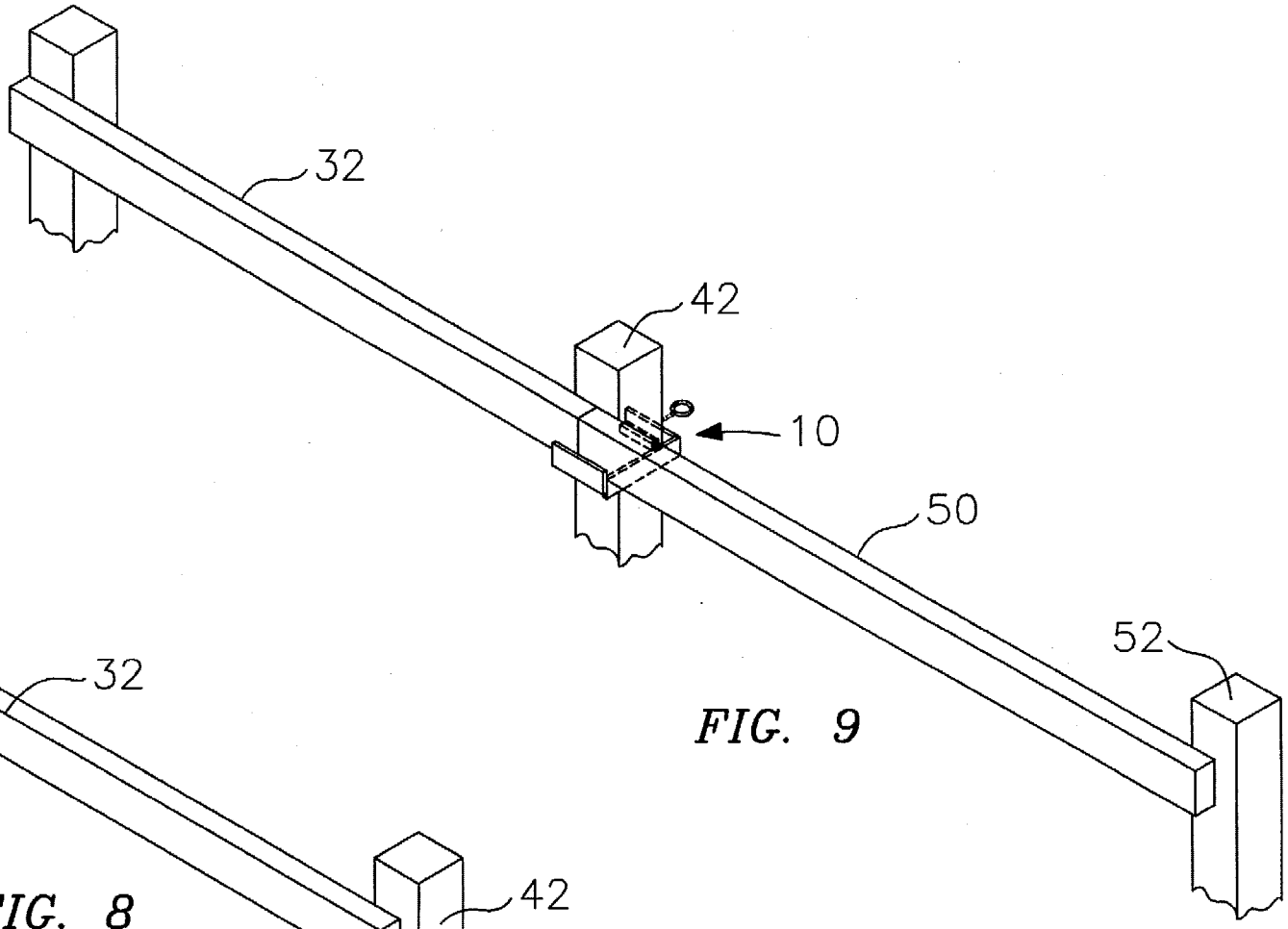
FIG. 9 is a pictorial view showing the apparatus in the position shown in FIG. 2 attaching a cross piece to an intermediate post.

As shown in FIG. 2, the bottom surface 44 of plate 28 is on the same level as edge 46 of base 14. Thus when the C-shaped frame has been flipped over, as shown in FIG. 2, base 14 does not form a stop. The lower portion 48 of the inside surface 38 of leg 16 will form part of a channel for receiving a pair of cross pieces 32 and 50, as shown in FIGS. 7 and 9. This feature permits a single carpenter to complete the construction of the rail or fence, as shown in FIG. 9, since the end of cross piece 32, which has been attached to rail 42, will abut against the end of cross piece 50, thereby hold cross piece 50 in place with respect to beam 42, as shown in FIG. 9. The carpenter then may fix cross piece 50 to beam 52 after leveling beam 50 to place cross piece 50 in a proper position on beam 52.

Therefore, the apparatus of this invention may be used both for constructing the first cross piece from an end beam to an intermediate beam, as well as for attaching cross pieces between intermediate beams. Thus there is provided a simple, inexpensive and easy-to-use apparatus to enable a single person to construct a fence or decking rail.

From the foregoing description of the preferred embodiment of the invention, it will be apparent that many modifications may be made therein. It will be understood, however, that this embodiment of the invention is an exemplification of the invention only and that the invention is not limited thereto. It is to be understood therefore that it is intended in the appended claims to cover all modifications as fall within the true spirit and scope of the invention.

I claim:

1. An apparatus for temporarily supporting one end of a cross piece during installation to a pair of spaced apart beams comprising:

a C-shaped frame including a base;

first and second spaced apart legs extending from said base; said C-shaped frame adapted to partially surround one of the beams;

a platform; said platform attached to said first leg; said platform adapted to receive and hold one end of the cross piece in a position on one beam while the other end is secured to the other beam; said platform is attached to said base;

a portion of said base forms a backstop; said platform, said first leg and said base forming a channel located on one said of said apparatus for receiving the cross piece, whereby one end of the cross piece abuts against said portion of said base.

2. An apparatus as set forth in claim 1, further including a clamping apparatus attached to said second leg.

3. An apparatus as set forth in claim 2, wherein said clamping apparatus is adjustable.

4. An apparatus as set forth in claim 3, further including a hole in said second leg; said clamping apparatus including a threaded rod extending through said hole in said second leg; a handle being at one end of said rod; a pressure plate attached to the other end of said rod; said pressure plate adapted to contact a beam.

5. An apparatus as set forth in claim 1, wherein said platform and said first leg form a second channel located on the other side of the apparatus for receiving the end portions of two cross pieces.

6. An apparatus as set forth in claim 1, wherein said base and said first and second legs are in the form of plates; said platform mounted flush with portions of said bottom edge of said base plate and mounted at an intermediate position on said first leg, whereby first channel, which is blocked by said base, is formed on one side of said apparatus and a second channel, which is not blocked by said base, is formed on the other side of said apparatus.

7. An apparatus as set forth in claim 6, further including a clamping apparatus is attached to said second leg.

8. An apparatus as set forth in claim 7, wherein said clamping apparatus is adjustable.

9. An apparatus as set forth in claim 8, further including a hole in said second leg; said clamping apparatus including a threaded rod extending through said hole in said second leg; a handle being at one end of said rod and a pressure plate attached to the other end of said rod; said pressure plate adapted to contact a beam.

10. An apparatus for temporarily supporting one end of a cross piece during installation to a pair of spaced apart beams comprising:

a C-shaped frame including a base;

first and second spaced apart legs extending from said base; said base and said legs being in the form of plates; said legs extending from said base; said C-shaped frame adapted to partially surround one of the beams;

a platform; said platform attached to an intermediate position on said first leg; said platform attached to said base; said platform including a top surface and a bottom surface; said top surface forming a right angle with said base, wherein said base forms a stop for a cross piece; said top surface adapted to receive a cross piece; said bottom surface of said platform being substantially flush with the bottom edge of said base, wherein said bottom surface of said platform adapted to receive a pair of cross pieces abutting against one another;

an adjustable clamping apparatus attached to said second leg for securing said C-shaped frame to a beam.

* * * * *